United States Patent [19]

Grant

[11] 4,005,949

[45] Feb. 1, 1977

[54] VARIABLE CAPACITY ROTARY SCREW COMPRESSOR

[75] Inventor: Whitney I. Grant, Muskego, Wis.

[73] Assignee: Vilter Manufacturing Corporation, Milwaukee, Wis.

[22] Filed: Sept. 29, 1975

[21] Appl. No.: 617,692

Related U.S. Application Data

[60] Continuation-in-part of Ser. No. 513,542, Oct. 10, 1974, abandoned, which is a division of Ser. No. 403,195, Oct. 3, 1973, Pat. No. 3,859,814.

[52] U.S. Cl. ..... 418/15; 418/180; 418/201

[51] Int. Cl.[2] ..... F01C 1/16; F01C 21/12; F04C 17/12; F04C 29/08

[58] Field of Search ..... 418/15, 159, 180, 197, 418/201–203; 417/440; 62/510

[56] References Cited

UNITED STATES PATENTS

| | | | |
|---|---|---|---|
| 3,432,089 | 3/1969 | Schibbye | 418/201 |
| 3,568,466 | 3/1971 | Brandin et al. | 62/510 |
| 3,577,742 | 5/1971 | Kocher | 62/510 |
| 3,756,753 | 9/1973 | Persson et al. | 418/159 |

FOREIGN PATENTS OR APPLICATIONS

| | | | |
|---|---|---|---|
| 1,237,333 | 6/1971 | United Kingdom | 418/97 |

*Primary Examiner*—John J. Vrablik
*Attorney, Agent, or Firm*—James E. Nilles

[57] ABSTRACT

A variable capacity rotary screw compressor for a refrigeration system which includes a high pressure condenser, a subcooler, a main evaporator and an intermediate evaporator, the compressor including a primary inlet connected to receive low pressure vapor from the main evaporator, a secondary or intermediate inlet connected to receive high pressure vapor from the subcooler and/or intermediate evaporator, and a high pressure discharge port connected to the condenser, the compressor including a pair of oppositely rotating constant mesh helical lobe rotors and a slide valve to vary the capacity of the compressor by changing the points of admission of the low pressure vapor and the high pressure vapor to the rotors of the compressor, the points of admission of low pressure vapor and high pressure vapor being maintained in a fixed relation as the capacity of the compressor is varied.

3 Claims, 3 Drawing Figures

VARIABLE CAPACITY ROTARY SCREW COMPRESSOR

REFERENCE TO RELATED CO-PENDING APPLICATION

This application is a continuation-in-part of U.S. Patent application Ser. No. 513,542, filed Oct. 10, 1974, now abandoned which in turn was a divisional application of U.S. patent application Ser. No. 403,195, filed Oct. 3, 1973, and entitled "variable Capacity Rotary Screw Compressor" which issued on Jan. 14, 1975, as U.S. Pat. No. 3,859,814.

BACKGROUND OF THE INVENTION

Multiple suction variable capacity screw compressors are well known as shown in the Kocher U.S. Pat. No. 3,577,742, issued May 4, 1971. This type of a compressor has been further improved by using a slide valve to vary the capacity of the compressor from a minimum to a maximum level as shown in Edstrom U.S. Pat. No. 3,738,780, issued June 12, 1973. In compressors of this type the injection point for the secondary or high pressure vapor remains constant. The slide valve for the primary suction inlet is moved to change the capacity of the compressor from a maximum to a minimum producing a continuing change in the pressure of the intermediate vapor. At minimum capacity, the intermediate vapor pressure will be virtually at the same pressure level as the primary vapor pressure from the main evaporator. This continually changing intermediate vapor pressure level reduces the effect of the multiple suction arrangement such that maximum efficiency occurs only at maximum load conditions. There is virtually no increase in efficiency at minimum capacity because the pressures at the primary and secondary inlets are the same. Since the intermediate vapor pressure is continually varying in this type of a compressor, it is not suitable for use with intermediate evaporators. More specifically, a conventional multiple suction arrangement has the intermediate evaporator inlets located in the compressor casing around the circumference in an area where the slide valve is not located resulting in the openings always being in a fixed position so that, as the slide valve moves, the distance between the start of compression and the point at which the secondary vapor is injected is continually decreasing as the slide valve moves to the unloaded position. In fact, when the slide valve has moved to the point where the compressor is unloaded only 30%, the intermediate port is uncovered and the intermediate pressure is then reduced to the same pressure level as the main evaporator eliminating the beneficial effects of the constant intermediate pressure at a level above the main evaporator suction pressure. In some prior art patents, namely, Schibbye U.S. Pat. No. 3,314,587, Schibbye U.S. Pat. No. 3,342,089, Persson U.S. Pat. No. 3,756,753, Edstrom U.S. Pat. No. 3,734,653, and British Pat. No. 1,237,333, ports in the slide valve which have nothing to do with a high pressure suction are used for the injection of lubricating and cooling oil. This has no effect on the capacity of the compressor and does not provide for the increased capacity by being able to admit additional refrigerant vapor to the compressor through the high pressure suction port. These patents use a slide valve as a means for admitting cooling oil or refrigerant liquid for the cooling purposes and is a means of improving on the cooling and lubrication of a compressor. It has nothing to do with increasing the capacity of the compressor from the standpoint of refrigerant vapor compressed and rate of refrigerant circulated through the system.

SUMMARY OF THE INVENTION

The variable capacity screw compressor of the present invention provides for the admission of secondary vapor at high pressure throughout the full stroke of the slide valve. The point of injection of the secondary high pressure vapor is maintained constant with respect to the point where the vapor begins to compress in the rotors. The secondary high pressure vapor is always introduced into the rotors at a fixed distance from the start of compression in the rotors. A relatively constant or fixed pressure relationship is maintained between the main evaporator suction inlet and the intermediate evaporator pressure level. Since the pressure relation between the primary and secondary gas is maintained constant, the compressor can be used with an intermediate evaporator and still obtain the advantages of desuperheating and subcooling.

The present application concerns a slide valve in which the auxiliary ports are located, which makes the auxiliary ports movable rather than fixed. The improvement obtained when the high suction pressure ports are contained in the slide valve is that these ports move when the slide valve moves and provide for the admission of the high pressure vapor into the compressor rotors at minimum capacity position of the slide valve, as well as at full capacity position of the slide valve and any point in between, thus maintaining the same pressure level in the high suction pressure connection at the compressor. With the Kocher arrangement when the slide valve moves off of the 100% capacity position, it moves towards the fixed high pressure suction ports eventually uncovering them at approximately 70% compressor capacity, after which the high suction pressure ports are no longer "high pressure ports" and there is no supercharging, so to speak, of the rotors.

Another advantage of the present invention using a slide valve as a means of locating the intermediate inlet port a fixed distance from the cut-off point of the admission of the low pressure vapor is that the location of the inlet ports for the intermediate gas can be located at different points in the slide valve. In other words, the distance from the cut-off of the inlet vapor from the low pressure receiver to the location of the intermediate ports can be varied. The location of the intermediate port determines the intermediate pressure at which the intermediate evaporator or sub-cooler is going to be operating, and, in itself, has an effect on overall system efficiency. By changing from one slide valve to another wherein the intermediate ports are located a greater or lesser distance from the cut-off point of the slide valve, a machine can be converted in the field to obtain a change in intermediate pressure and a change in system performance as the change in job requirements would demand. With the fixed port device, it is never possible to make any change in the location of the intermediate ports and, therefore, never possible to make any change in the intermediate pressure level. Another advantage to the present invention is that in multiple compressor systems, where there may be one or more subcoolers, or intermediate evaporators, all inter-connected and with branching lines out to the intermediate ports on several compressors, a much simpler system is possible in that there is no variation in this intermediate pressure from one compressor to another, whether they are all running at full load or minimum capacity or somewhere in between. In U.S. Pat. No. 3,568,466, a movement of the slide valve to where the compressor capacity is reduced only 30%, the intermediate pressure is the same as the low pressure inlet to the compressor. It then becomes very complicated and additional control devices are required to balance the flow of intermediate vapor to each of the compressors when there is more than one compressor and also it is necessary to provide these controls to maintain a constant evaporating pressure in either the subcooler, or the intermediate evaporator. If the material being cooled in the subcooler, or the intermediate evaporator were sensitive to freezing, such as water would be, there would be danger of freeze-up and rupture of the intermediate evaporator when the intermediate evaporating pressure is lower below the freezing point of the fluid as the slide valve in U.S. Pat. No. 3,568,466 moves off of the full load position, resulting in the intermediate pressure dropping rather rapidly.

DRAWINGS

DESCRIPTION OF THE INVENTION

Figure 1:
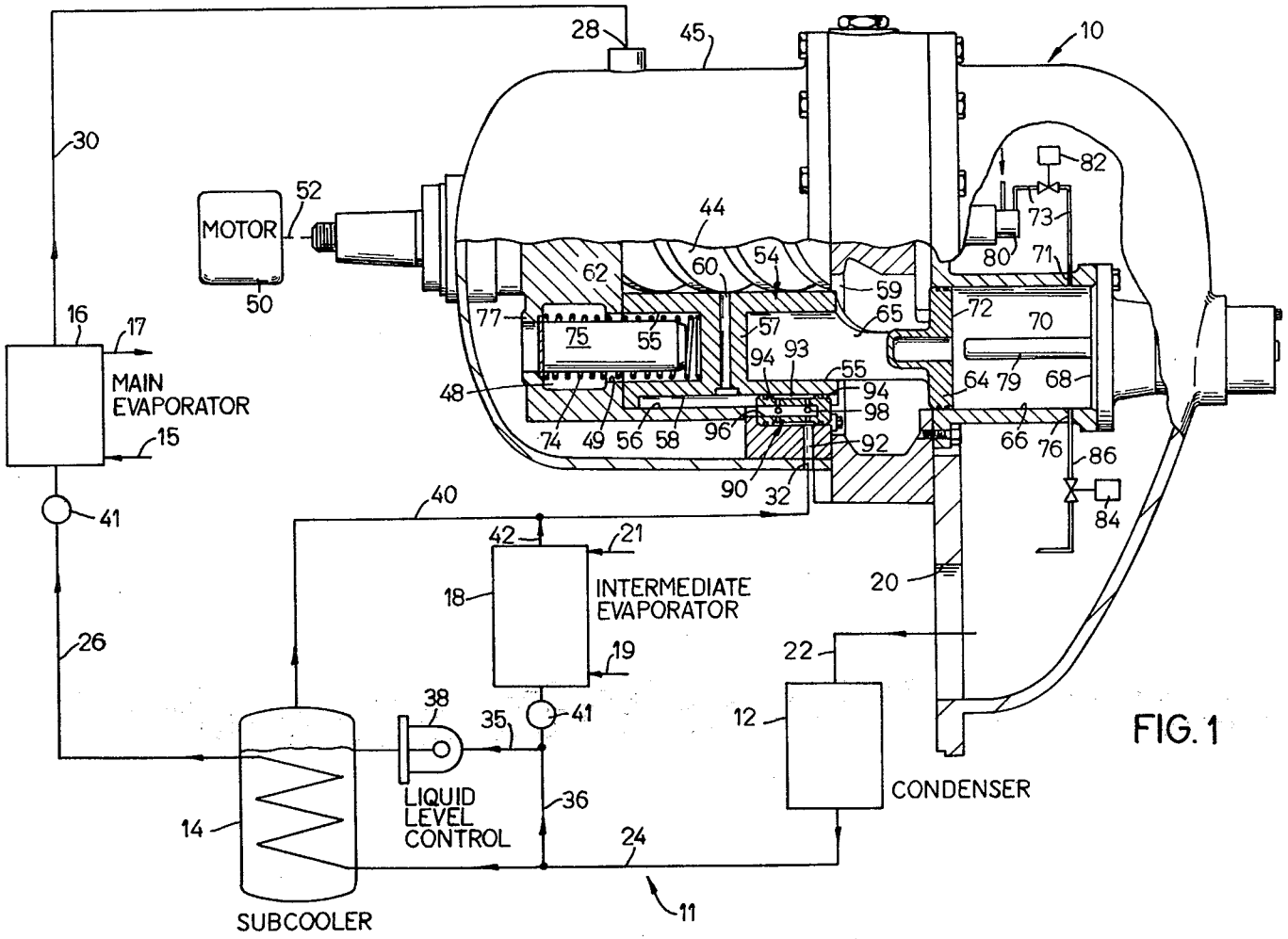
FIG. 1 is a schematic view of a refrigeration system of the two suction pressure level type connected to a multiple suction screw compressor which has been partly broken away to show the slide valve of the present invention.

The multiple suction screw compressor 10 of the present invention as shown in FIG. 1 is connected to a refrigeration system 11 which generally includes a condenser 12, a subcooler 14, a main evaporator 16 and an intermediate evaporator 18. In this regard, the condenser 12 is connected to the discharge outlet 20 of the compressor 10 by a high pressure discharge conduit 22. High pressure liquid from the condenser 12 is conducted to the subcooler 14 through a high pressure liquid conduit 24. The cooled liquid from the subcooler 14 is conducted to the main evaporator 16 through a conduit 26. The main evaporator 16 is connected to the low pressure vapor inlet port 28 in the compressor 10 through a conduit 30.

The level of liquid refrigerant in the subcooler 14 is maintained at a predetermined level by a liquid level control 38 connected to the high pressure liquid conduit 24 through conduits 35 and 36. High pressure gas or vapor from the subcooler 14 is conducted to a fixed secondary or intermediate high pressure vapor inlet port 32 in the compressor 10 through a conduit 40.

Additional high pressure gas or vapor is provided by means of the intermediate evaporator 18. The evaporator 18 is connected across the subcooler 14 by conduits 36 and 42. The high pressure vapor from the subcooler 14 and intermediate evaporator 18 is drawn into the compressor through conduit 40.

The evaporators 16 and 18 are conventional and can be of the shell and tube brine cooler type in which brine is introduced into and taken out of the evaporators through conduits 15, 17 and 19, 21, respectively. The intermediate evaporator 18 provides vapor at a higher pressure than the main evaporator 16. This difference in pressure should normally be at least 15 psi. Control valves 41 can be provided in each of the evaporators 16 and 18 to control the flow of refrigerant to these evaporators. The control valves function to reduce the pressure of the liquid to the required evaporator pressure as is generally understood.

VARIABLE CAPACITY COMPRESSOR

The variable capacity compressor 10 of the invention generally includes a housing 45 having a pair of oppositely rotating constant mesh helical lobe rotors 44 and 46 positioned within bores 43 and 47 within the housing 45. The rotors 44 and 46 cooperate to provide a pumping and compressing action in a known manner. The rotors define lobe chambers which close off low pressure vapor from chamber 48 provided at the end of the rotors. These lobe chambers become progressively smaller to compress the low pressure gas or vapor trapped therein. The low pressure vapor is drawn via conduit 30 from the main evaporator 16 to the primary low pressure suction inlet 28 and then into chamber 48 at the end of bores 43 and 47.

The compressor 10 includes a discharge port 20 for discharging high pressure refrigerant which has been compressed between the rotors to the condenser 12 through the conduit 22. The condenser 12 is conventional and functions to receive the high pressure vapor from the compressor discharge port 20. The compressor 10 is driven by means of an electric motor 50 which is connected directly to the rotors 44 and 46 by a drive shaft 52.

SLIDE VALVE

In accordance with the invention, the fixed intermediate pressure inlet port 32 is connected to the lobe chambers between the rotors 44 and 46 by means of a slide valve 54. The slide valve 54 is positioned for axial movement in a bore 56 provided in the housing 45 in a parallel relation to the rotor lobes 44 and 46 and is connected to chamber 48 through opening 49. The slide valve 54 forms a movable wall for a portion of the wall of the bores 43 and 47 in the housing 45 and is axially movable in the bore 56 from the maximum capacity position shown in FIG. 1 to a minimum capacity position shown in FIG. 2. The mass of the valve 54 can be reduced by providing a recess 55 in each end of the valve which terminate at a center section 57.

The slide valve 54 is biased to the minimum capacity position by means of a spring 74. The spring 74 is mounted on a guide rod 75 which extends into the recess 55 on one end of the valve 54. The spring 74 is seated on a fixed plate 77 and bears against the center section 57 of the valve.

The point of admission of low pressure vapor into the cavity or chamber between the rotors is determined by the position of the face or end 62 of the slide valve 54. In this regard and referring to FIG. 2, it should be noted that in the minimum capacity position of the slide valve 54, a portion of the bores 43 and 47 for rotors 44 and 46 will be opened to the bore 56. The rotor lobes, therefore, cannot close until the lobes pass the end 62 of the slide valve 54. The stroke of the compressor at the minimum capacity position will be equal to the distance from the end 62 of the valve 54 to the discharge end 59 of the rotors 44 and 46.

Means are provided in the side valve 54 for connecting the fixed intermediate inlet port 32 with the cavities formed in the rotors 44 and 46. Such means is in the form of an arcuate slot 58 provided in the side wall of the valve 54 and a passage 60 which extends through the center section 57 of the valve from the slot 58 to the cavity in the rotors.

The location of the point of introduction of the high pressure vapor through the passage 60 into the rotors is preferably at a point in the compression of the vapor trapped in the cavity of the rotors at suction inlet cut-off that will result in the optimum intermediate pressure that produces the maximum system efficiency. It will be noted that the distance between the end 62 of the slide valve 54 and the movable intermediate pressure inlet opening 60, which is located in the slide valve, remains the same, whether the slide valve is fully to the left at the maximum capacity position or fully to the right in the minimum capacity position.

The total length available on the rotors 44 and 46 for compressing the gas, however, varies from the full stroke (FIG. 1) when the slide valve 54 is in the fully loaded position to the minimum stroke (FIG. 2) when the slide valve is in the minimum capacity position. The introduction of the intermediate pressure gas, however, remains constant in relationship to the point at which the gas in the rotors begins to compress. This, therefore, results in the intermediate gas always being introduced into the rotors at a fixed point from the start of the compression and, therefore, maintains a relatively constant pressure relationship between the main evaporator suction inlet and the intermediate evaporator pressure level.

The position of the slide valve 54 in the bore 56 is controlled by means of a piston 64 which is axially slidable in a bore 66 in housing 45. The piston 64 includes a face 72 and is connected to the valve 54 by means of flanges 65. The bore 66 is closed by an end plate 68 to form a chamber 70 for receiving pressure liquid through a port 71.

Means are provided to control the amount of movement of the piston 64 in the form of an adjustable pin 79 secured to a plate 68.

The slide valve 54 can be controlled by the admission of pressure liquid from any source such as oil pump 80 into chamber 70 through passage 71. In the embodiment shown in FIG. 1, a schematic circuit is shown for the control liquid which is controlled by means of a high pressure oil solenoid valve 82 provided in the oil line 73 between the oil pump 80 and the chamber 70. The build up of pressure liquid in the chamber 70 will move the slide valve toward the maximum capacity position against the bias of spring 74. Pressure is relieved in the chamber 70 by means of an oil drain solenoid 84 provided in a discharge line 86 connected to the port 76. Opening of the oil drain solenoid 84 will relieve the pressure in the chamber 70 allowing the spring 74 to move the slide valve towards the minimum capacity position.

The slide valve 54 can be positioned anywhere between the maximum capacity position and the minimum capacity position by the proper control of the solenoids 82 and 84. In the maximum capacity position of the slide valve 54, the stroke will now be equal to the full length of the rotors since the end 62 of the valve 54 is located at the inlet end of the rotors. In the maximum and minimum capacity positions of the valve 54 the secondary vapor will be admitted at a fixed distance from the end 62 of the valve 54.

Means are provided for guiding the slide valve 54 in the housing in order to maintain the alignment of the crest edge 88 of the slide valve 54 between the rotors 44 and 46. Such means is in the form of a pin 90 provided in a groove 92 in housing 45 which is axially aligned with the slot 58. The pin 90 includes a reduced diameter center section 93 and a piston head 94 at each end of the center section 93. The piston heads 94 have outer diameters substantially equal to the diameter of the groove 92 and slot 58.

Fluid communication is provided through the guide pin 90 by means of an open passage 96 and transverse ports 98. Fluid entering the groove 92 around the center section 93 will flow through ports 98 into passage 96 and out into groove 58.

Figure 2:
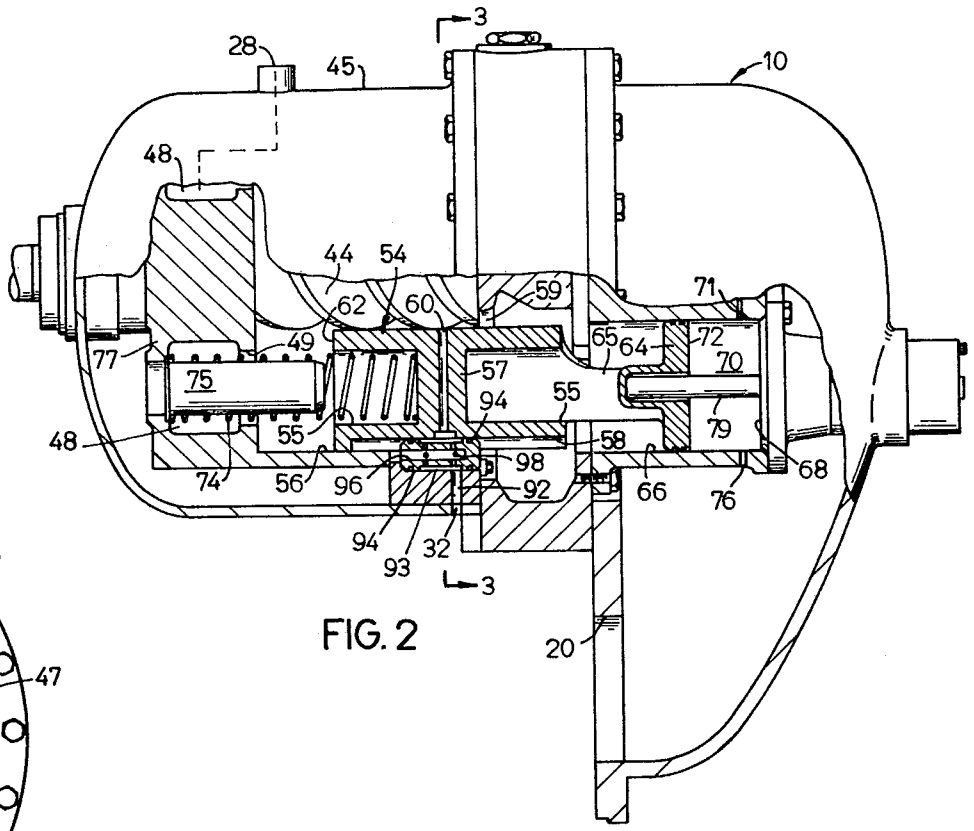
FIG. 2 is an elevation view of the multiple suction screw compressor partly broken away to show the slide valve in the minimum capacity position.
Figure 3:
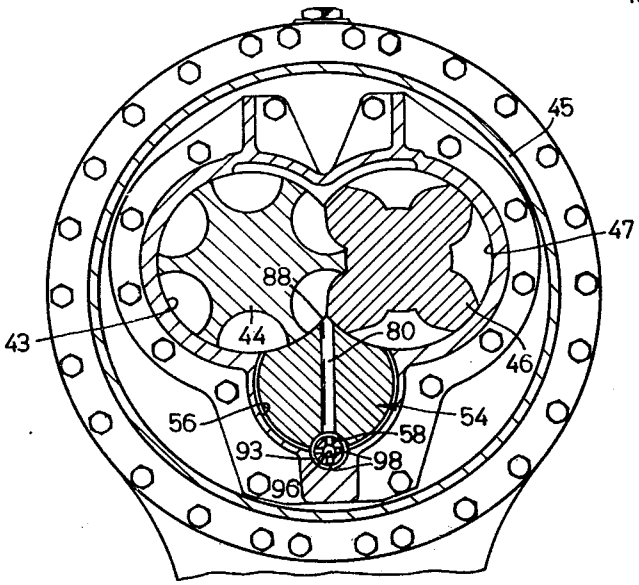
FIG. 3 is a section view taken on line 3—3 of FIG. 2 showing the slide valve.

In operation, the slide valve 54 in the maximum capacity position shown in FIG. 1 provides for the admission of high pressure vapor at a fixed distance from the low pressure vapor inlet chamber 48. This distance is equal to the length of the compression chamber immediately after low pressure suction cut-off. When the slide valve 54 is in the minimum capacity position as seen in FIG. 2, the low pressure suction inlet will be at a point corresponding to the face 62 of the slide valve 54. The end face 62 of the slide valve 54 will determine the point of low pressure suction inlet cut-off.

High pressure vapor will still be introduced into the cavities between the rotors 44 and 46 at the same distance from low pressure vapor inlet cut-off as in the maximum capacity position. Maximum efficiency will, therefore, be maintained through the full stroke of the slide valve 54 since the same pressure relationship will always be present between low pressure vapor inlet 28 and high pressure vapor inlet 32.

The slide valve 54 does have some control over vapor coming from the main evaporator 16 at least as far as the quantity of vapor that is taken into the compressor 10 indirectly as a result of the position of the slide valve, which controls the point at which compression begins. When the slide valve 54 is in the minimum capacity position, the compression begins so far down the length of the rotors 44 and 46 that there is very little inlet gas space left in the rotor lobes before the compression starts and there is then very little gas compressed and forced out of the compresser 10, which is subsequently replaced by new vapor that comes in through line 30. When the slide valve 54 on the other hand is in the full capacity position, the entire length of the rotor chambers is filled with gas from line 30, which means there is a larger quantity of gas in the chambers. at which point the compression begins with the slide valve again controlling the point of cut-off. In essence, the slide valve 54 controls the flow of high pressure vapor from the subcooler 14. With this arrangement, high pressure vapor is admitted from either an intermediate evaporator 18, subcooler 14, or similar devices, at a point beyond the cut-off the slide valve 54 that remains constant and, therefore, the high pressure vapor is admitted into the chambers at a point where the pressure will also be constant and a fixed pressure above the low pressure vapor.

The gain in capacity of the compressor 10 with a correspondingly smaller power requirement for this gain in capacity is only obtained when the gas is admitted into the rotors at a pressure point that is always a fixed amount above the pressure of the low pressure vapor. For example, in U.S. Pat. No. 3,568,466, as soon as the slide valve moves off of the full capacity position, the vapor that comes in through the ports that are in a fixed location in the compressor housing is being admitted into the rotors at a point where the pressure is gradually becoming lower as the slide valve moves further from the full capacity position, since the beginning of compression is continually moving closer to the intermediate ports. After the slide valve is moved to where the compressor overall capacity has been reduced approximately 30%, these ports begin to uncover as the slide valve continues to move and when the compressor capacity is less than 70% of full load capacity, the ports are uncovered and the intermediate pressure from the subcooler is being reduced to where the vapor expands down to the same pressure as the low pressure vapor and it is necessary to then compress this additional vapor, all the way from the low pressure to the discharge pressure at the outlet of the compressor. This then requires additional horsepower to compress the additional vapor. When, as in accordance with Applicant's invention, the vapor is always admitted at a point in the rotors beyond the cut-off point at any higher pressure than the low pressure vapor, it does not have to be compressed an additional amount, since it enters at a higher pressure and merely has to be compressed the remaining amount to exit from the discharge end of the compressor. This then requires less horsepower, since less compression of the intermediate vapor is required because it enters the compressor at a higher pressure.

The refrigeration system capacity is directly related to the total weight of refrigerant that goes through the compressor, both from the low pressure inlet line and the intermediate pressure inlet line. For example, in U.S. Pat. No. 3,568,466, when the intermediate ports are uncovered, the amount of vapor that can enter the rotors is limited to the volume of the rotors and there is no longer any so-called supercharging of the rotors with additional pounds of refrigerant. However, this can be done with a system in accordance with the present invention where the opening 60 for the intermediate pressure vapor is always beyond the cut-off point of the low pressure vapor, whereby the rotors, in effect, can be supercharged with additional pounds of refrigerant.

I claim:

1. A variable capacity multiple inlet rotary screw compressor comprising:

a housing having a low pressure suction inlet port for admission of refrigerant vapor at relatively low pressure, a high pressure suction inlet port for admission of refrigerant vapor at relatively high pressure, and a discharge port for discharge of compressed refrigerant vapor;

a pair of oppositely rotating constant mesh rotors defining chambers, said rotors being positioned within said housing to provide pumping and compressing action within said chambers, said chambers being connected at one end to the low pressure suction inlet port and at the other end to the discharge port; and means for regulating the point of cut-off of admission of low pressure refrigerant vapor into the compression chambers and for introducing relatively high pressure refrigerant vapor into the compression chambers at a constant distance from the point of cut-off whereby the amount of compression of said low pressure refrigerant vapor between said point of cut-off and the compression chambers where high pressure vapor is introduced is constant;

said regulating means including a slide valve positioned for axial movement within said housing and including cut-off means for controlling the point of cut-off of admission of low pressure refrigerant vapor to said chambers from said low pressure suction inlet port, at which point compression begins, a passage for connecting said high pressure suction inlet port to said chambers, said passage being located at a fixed distance from said cut-off means whereby relatively high pressure refrigerant vapor is admitted into said chambers at a constant distance from said cut-off means, and means for varying the position of said slide valve with respect to the rotors to vary the point of cut-off and thereby vary the capacity of the compressor.

2. A variable capacity multiple inlet rotary screw compressor comprising: a housing having a low pressure suction inlet port for admission of refrigerant vapor at relatively low pressure, a high pressure suction inlet port connectable to a source of a relatively high pressure refrigerant vapor and for admission of refrigerant vapor at relatively high pressure and a discharge port for discharge of compressed refrigerant vapor, a pair of oppositely rotating constant mesh rotors defining chambers, said rotors being positioned within said housing to provide pumping and compressing action within said chambers, said chambers being connected at one end to the low pressure suction inlet port and at the other end to the discharge port, a slide valve positioned for axial movement within said housing and including cut-off means for controlling the point of cut-off of admission of low pressure refrigerant vapor to said chambers from said low pressure suction inlet port, at which point compression begins, and said slide valve including a passage for connecting said high pressure suction inlet port to said chambers, said passage being located at a fixed distance from said low pressure inlet cut-off means so that refrigerant vapor at relatively high pressure is admitted into said chambers at a location where the refrigerant vapor pressure in said chambers is substantially constant and greater than the pressure of the low pressure refrigerant vapor, and means for varying the position of said slide valve with respect to the rotors to vary the cut-off point and thereby vary the capacity of said compressor.

3. A variable capacity multiple inlet rotary screw compressor comprising: a housing having a pair of bores, a pair of oppositely rotating constant mesh rotors defining compression chambers and being positioned within said bores to provide pumping and compressing action within said chambers, a low pressure suction inlet port in said housing for admission of refrigerant vapor at relatively low pressure connected to the other end of said bores and a high pressure suction inlet port in said housing connectable to a source of a relatively high pressure refrigerant vapor and for admission of high pressure refrigerant vapor, a third bore in said housing parallel to said pair of bores, an axially movable slide valve positioned in said third bore and forming a portion of the wall of said pair of bores, said slide valve including low pressure inlet cut-off means for controlling the point of cut-off of admission of low pressure refrigerant vapor to said chambers from said low pressure suction inlet port, at which point compression begins, and said slide valve including passage means for connecting said high pressure suction inlet port to said chambers, said passage means being located at a fixed distance from said low pressure inlet cut-off means so that relatively high pressure refrigerant vapor is admitted into said chambers at a location where the refrigerant vapor pressure in said chambers is substantially constant and greater than the pressure of the low pressure refrigerant vapor, and means for moving said slide valve axially in said third bore to vary the cut-off point and thereby vary the capacity of said compressor.

* * * * *